US005125857A

United States Patent [19]

Mochizuki

[11] Patent Number: 5,125,857

[45] Date of Patent: Jun. 30, 1992

[54] HARNESS METHOD FOR USE IN COLD WEATHER OIL FIELD OPERATIONS AND APPARATUS

[75] Inventor: David A. Mochizuki, Anchorage, Ak.

[73] Assignee: Nabors Industries, Inc., Houston, Tex.

[21] Appl. No.: 654,775

[22] Filed: Feb. 13, 1991

[51] Int. Cl.[5] ..... H01R 13/00

[52] U.S. Cl. ..... 439/894; 166/901; 175/219

[58] Field of Search ..... 439/502, 894; 175/219; 166/901, 356, 65.1, 66; 285/61; 52/220, 221

[56] References Cited

U.S. PATENT DOCUMENTS

| | | | |
|---|---|---|---|
| 2,097,868 | 11/1937 | Beard | 250/36 |
| 3,120,411 | 2/1964 | Strumpell | 312/271 |
| 3,399,909 | 9/1968 | Ambrose | 285/61 |
| 3,626,836 | 12/1971 | Schneidler | 175/219 |
| 3,796,977 | 3/1974 | Elliott et al. | 333/95 |
| 3,946,571 | 3/1976 | Pate et al. | 175/219 |
| 4,352,008 | 9/1982 | Hofer et al. | 219/540 |
| 4,391,297 | 7/1983 | Knight | 137/615 |
| 4,474,213 | 10/1984 | Jameson | 137/615 |

FOREIGN PATENT DOCUMENTS

| | | | |
|---|---|---|---|
| 823722 | 11/1959 | United Kingdom | 174/153 G |

*Primary Examiner*—Neil Abrams

[57] ABSTRACT

A method and apparatus is presented for facilitating the installation of electrical cables in sub-zero temperatures by heating the cables to make them more flexible and easier to work with. The cables and the workers thereon are sheltered from the elements to enhance the safety of the workers and improve the useful operating life of the equipment.

13 Claims, 1 Drawing Sheet

HARNESS METHOD FOR USE IN COLD WEATHER OIL FIELD OPERATIONS AND APPARATUS

INFORMATION REGARDING RELATED APPLICATIONS

This invention is related to the following applications, all of which have been assigned to the assignee of the present invention and concurrently filed herewith: Self-Propelled Drilling Module, Ser. No. 07/655,562 pending, Fully Articulating Ramp Extension for Pipe Handling Apparatus, Ser. No. 07/654,989 pending, Method and Apparatus for Controlling the Transfer of Tubular Member Into a Shelter, Ser. No. 07/654,237, allowed and Mobile Drilling Rig for Closely Spaced Well Center, Ser. No. 07/654,754, pending.

FIELD OF THE INVENTION

The invention relates generally to a method and apparatus for placing modules of a modular oil field workover or drilling rig in electrical communications. It is necessary to connect electrical cables between adjacent components of a modular drilling rig for power transmission and control.

DESCRIPTION OF THE RELATED ART

In the arctic regions of the world the temperature can drop to −70 degrees Fahrenheit. Such harsh conditions make it difficult and sometimes impossible for man and machine to perform the simplest of tasks. Soft pliable materials can become rigid and brittle in the frozen arctic, not to mention the fingers and toes of the human workers. In the extreme intemperateness of the arctic zone the protection of man and machine from the elements is paramount. Designing equipment suitable for the environment can be as challenging as designing equipment suitable for the task.

Cold weather not only represents health hazard to the arctic workers but a financial risk to their employers as well. The enormous expense of transporting replacement parts under adverse conditions over the primitive road ways of the North Slope puts a premium on the useful operating life of materials and equipment. The present invention is directed to overcoming, or at least minimizing, one or more of the problems set forth above.

SUMMARY OF THE INVENTION

In accordance with one aspect of the present invention a method is provided for electrically connecting a plurality of modules in a modular oil field system in a frigid environment comprising the steps of placing a cable boom on the first of a plurality of modules; placing a set of electrical cables on a cable tray attached to the cable boom so that the cables protrude past the end of the cable boom; rotating the free end of the cable boom containing the protruding cable ends away from the first module and toward an adjacent module; providing a cabinet in the adjacent module wherein the cabinet has an aperture to place the interior of the cabinet in direct communication with the outside of the adjacent module; introducing the protruding portion of the electrical cables through the aperture in the cabinet and into the cabinet in the adjacent module; and connecting the cables to a cable connector panel located in the adjacent module.

In another aspect of the invention a method is provided for heating the cabinet to a temperature above the temperature outside the module and warming the cable to a temperature above freezing prior to connecting the cable between the modules.

In yet another aspect of the invention a method is provided for withdrawing a portion of the warmed cable from the cabinet while the cable is in a warm and flexible state so that the cable assumes a natural catenary between the cabinet aperture and the cable boom as shown in the dotted lines for cables 26 shown in FIG. 2.

In yet another aspect of the invention a method is provided for connecting electrical cables to an angled panel face to increase the radius of curvature of the bends in the cable that are required to connect the cable to the panel face.

In yet another aspect of the invention a method is provided for sealing the cabinet aperture to reduce leakage of heat and entry of cold air from the outside when said cables are introduced through the aperture and into the heated cabinet or when no cables are introduced through the aperture.

In yet another aspect of the invention a method is provided for establishing a positive pressure in the heated cabinet by forcing heated air into the cabinet through air ducts.

In another aspect of the invention an apparatus is provided for electrically connecting modules in a modular oil field system which includes a set of electrical cables; a cable boom positioned on a first module and configured so that the cables protrude past the end of the cable boom; a cabinet located in an adjacent module; and a border defining an aperture between the interior of the cabinet and the outside of the module for receiving the cable.

In another aspect of the invention an apparatus is provided for electrically connecting modules in a modular oil field system which includes a heat generating means for heating the cabinet in the adjacent module to facilitate warming an inserted cable until it becomes flexible.

In another aspect of the invention an apparatus is provided for electrically connecting modules in a modular oil field system which includes an angled panel face to increase the radius of curvature of the bends in the cables that are required to connect the cables to the panel face.

In another aspect of the invention an apparatus is provided for electrically connecting modules in a modular oil field system which includes a seal for the cabinet aperture area to reduce leakage of heat from the cabinet and entry of cold air into the cabinet from outside of the heated cabinet.

In another aspect of the invention an apparatus is provided for electrically connecting modules in a modular oil field system which includes a heat generating means for heating the thermal cabinet by directing heat from a heat source through holes in the cabinet and into the cabinet.

BACKGROUND OF THE INVENTION

Prior to the invention of this method and apparatus, arctic oil rig operators , desiring to dress the ends of cable with conventional plugs or connectors, had to build temporary enclosures, possibly of tarpaulin or plywood. A portable heater was placed inside the temporary enclosure to facilitate some warming of the cable and provide shelter for the electrician who dressed and connected the cable. Plug panels were external to the rig modules so that the workers were outside in the −70 degree weather with only a small portable heater to provide warmth. The conditions were very difficult to work in because the cables were less flexible in the freezing weather, and the electricians had to work with minimal shelter or sometimes none at all. The cables were often frozen solid in a tangled mass and muddy from lying on the ground making them difficult to work with. Moreover, in the Arctic when a worker is required to perform tasks outdoors, the worker must wear a cumbersome parka, hardhat and gloves.

With the present invention, however, cable may be introduced through the aperture in thermal cabinet and provided time to warm to a temperature at which the cable is flexible. Then the electrician can work inside the thermal cabinet comfortably in shirt sleeves with a warmed flexible cable that can be easily dressed and installed.

GENERAL DESCRIPTION OF THE INVENTION

In a configuration of closely spaced wells it is advantageous to use a modular drilling rig assembled from preconstructed, self-contained modules to fit in and among the closely spaced wells. Such a modular system is small so that rig operators can perform well servicing and workovers without disturbing operation of adjacent wells. Such modular rigs are more cost effective because they are more quickly assembled and disassembled and can operate without the usual delays associated with the erection and disassembly of conventional workover oil rigs.

With a modular system, the modules are simply disconnected from each other and moved to the next location and reconnected. The modular system can thus be disconnected, moved and placed back into operation within a matter of hours resulting in a large savings in time and money. The modules in a drilling or workover rig might consist of a main drilling module and an adjacent mud module connected by an electrical umbilical. In the Arctic where temperatures dip into the −70 degrees Fahrenheit range, electrical umbilical or wiring harnesses become rigidly frozen and inflexible. It becomes difficult to position the cables to make connections between the modules. The frozen cables will not bend easily.

Forcing such a frozen cable to bend into position may cause undesired changes in the cables electrical characteristics or otherwise result in physical degradation or damage. The dielectric and conductivity of the cable may change under the physical strain, and bending when frozen may even destroy the cable. Extreme mechanical strain may cause a short circuit which can result in the endangerment of human life from electrocution.

Short circuits may also create risk of harm to the rig's equipment. Equipment failures in the frozen Arctic can present serious problems because relocation of replacement parts is costly and down time while waiting on replacements is critical to cost-effective well-maintenance operations. Human life may be also be placed in jeopardy if a short circuit damages the life support equipment at the operating site. Therefore, the rig must be designed to maintain the integrity of the electrical cables to prevent risk to human life and harm to the rig equipment itself.

The invention protects the integrity of the electrical umbilical by providing a method and apparatus for warming the frozen cable so that it becomes flexible and can be positioned for connection without harming the cable either physically or electrically.

It is the object of the present invention to provide a method and apparatus to warm a frozen cable to make the cable easier to manipulate.

It is another object of the present invention to protect the workers in the area from being electrocuted by coming in contact with faulty electrical cables.

It is still another object of the present invention to protect the cable from damage by contact from heavy equipment or other objects. These and other objects of the invention will become more apparent after reading this description of the invention.

In one preferred embodiment of the invention the cable may be supported in part by a rotating manual boom. The operator neatly bundles the cables into a cable tray mounted on the boom. The operator then swings the boom towards the adjacent module where there is an aperture cut out, approximately 8 inches high by 12 inches wide. A length of cable can protrude or extend beyond the cable tray by about fifteen feet. An operator may insert the portion of the cables, which extend beyond the cable tray, into the aperture in a thermal chamber or cabinet. The thermal chamber or cabinet contains the plug panel where the electrical cables will eventually be connected by an electrician.

The temperature inside the cabinet is approximately 70 degrees Fahrenheit while the temperature outside can be as low as −70 degrees Fahrenheit. The cables remain in the thermal chamber and are heated until they thaw out and become flexible. The cables in the thawed condition are soft and easy to install into the plug board or, if necessary, to dress a conventional plug or connector.

The boom serves to prevent damage to the cable harness during transit. The boom supports the cable harness in the air and off the ground to prevent the cables from dragging and being damaged.

In the storage or transit mode the operator rotates or swings the boom into travel position back toward and against the carrier module. The cable can be rolled up neatly and placed on an elevated working deck or platform above the ground. In its working or "rigged-up" position the boom is rotated approximately 150 degrees out from the main drilling module front wall toward the adjacent module to facilitate the cable harness installation through the aperture in the thermal chamber.

The thermal cabinet is designed so that the portion of the cable harness that protrudes beyond the end of the cable harness boom can be draped inside the thermal chamber. The cable harness can drape down inside the thermal chamber and then back up to connect to the plug panel forming a "U" shape inside the thermal cabinet. The thermal cabinet is approximately eight feet high and is large enough to accommodate comfortably an electrician working inside the thermal chamber.

BRIEF DESCRIPTION OF THE DRAWINGS

FIG. 1 is a top view of the harness boom rotating into position so that the electrical umbilical can be connected between adjacent modules.

FIG. 2 is an orthographic projection of the thermal cabinet showing the electrical umbilical inserted through the aperture in the thermal cabinet.

DESCRIPTION OF THE PREFERRED EMBODIMENT

Figure 1:
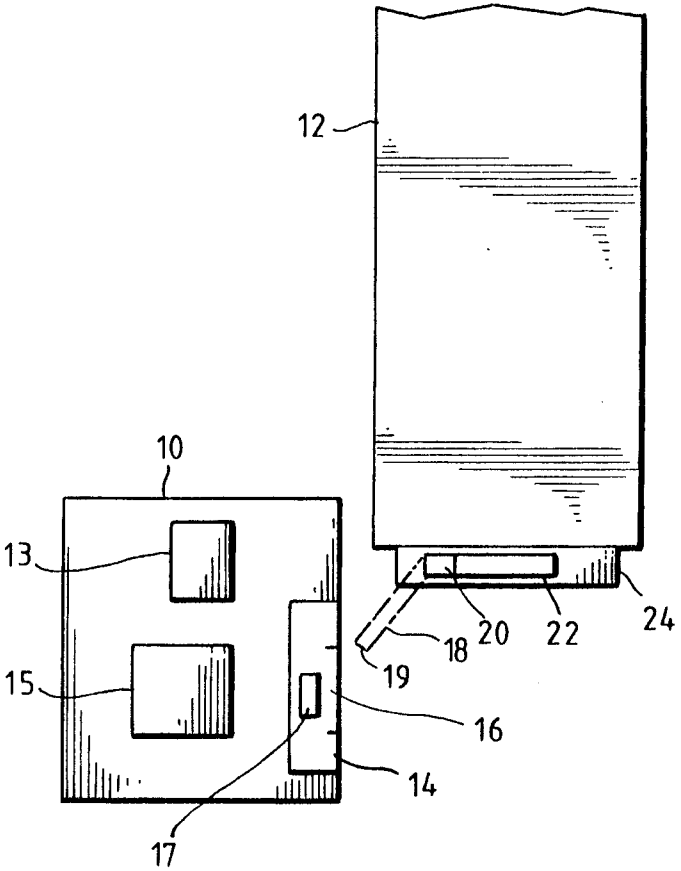
FIG. 1.

In one preferred embodiment of the invention, two adjacent modules, the mud module 10, and a drilling module 12, are interconnected electrically using a bundle of cables 26. The cables 26 are bundled together and laid in a cable tray attached to the cable harness boom 22. The cable harness boom 22 is rotated away from the drilling module approximately 150 degrees toward the mud module to as shown in FIG. 1. The boom is pivoted about the boom hinge attachment 22. The cable harness boom in the extended position 18 positions the cables 26 adjacent a thermal chamber or cabinet 14. The cable 26 is then inserted through the thermal cabinet aperture 16.

The heated thermal cabinet 14 is located on a side wall of the mud module 10. Heat is provided from a boiler 13 or a diesel engine 15 or can be provided by a portable heating unit if necessary. The heat is transmitted to the heated thermal cabinet 14 from the heat sources such as the boiler 13 and the diesel engine 15 by apertures 17 in the top and bottom of the heated thermal cabinet 14. A positive pressure is maintained in the thermal cabinet 14 so that hot air escapes but cold air does not come in when the aperture is opened. The cables 26 and cable connectors 28 are left inside the heated thermal cabinet 14 until the frozen cables are warmed. The ambient temperature inside the heated thermal cabinet 48 is approximately 70 degrees Fahrenheit. The ambient temperature outside 50 of the heated thermal cabinet can be as low as −70 degrees Fahrenheit. The cables remain inside the heated thermal cabinet 14 until they are thawed and become flexible and easily connected to the angled connector panel face 30. The connector panel 30 is located inside the heated thermal cabinet 14 providing a comfortable work space for an electrician to connect the cable connectors to the angled connector panel face 30 without being exposed to the outside freezing temperatures. The panel face 30 may be positioned at any desired angle 31 with respect to a front wall 33 of the panel. The heated thermal cabinet is large enough to provide a comfortable work space for an electrician and to contain the cables during their warming period. Additional heat can be provided by a forced air heating duct 34 should this become necessary. The aperture can be sealed to reduce heat leakage and cold air from entering the chamber by placing conventional insulating material such as fiberglass in the portion of the aperture 16 not occupied by the cables 26. The aperture 16 can be left open, however, and the positive pressure within the chamber will maintain an adequate temperature to achieve thawing and warming of the cables 26.

When the modules 10 and 12 are disassembled and readied for transit, the boom is preferably rotated to the stowed position. 22. The cables may be neatly coiled and placed on the boom platform 24. This prevents the cables from dragging on the frozen ground during transit and also positions them for reconnection when the modules are placed back into operation. The angled connector panel face 30 facilitates connection to the connector panel face without extensive bending of the cables 26.

Figure 2:
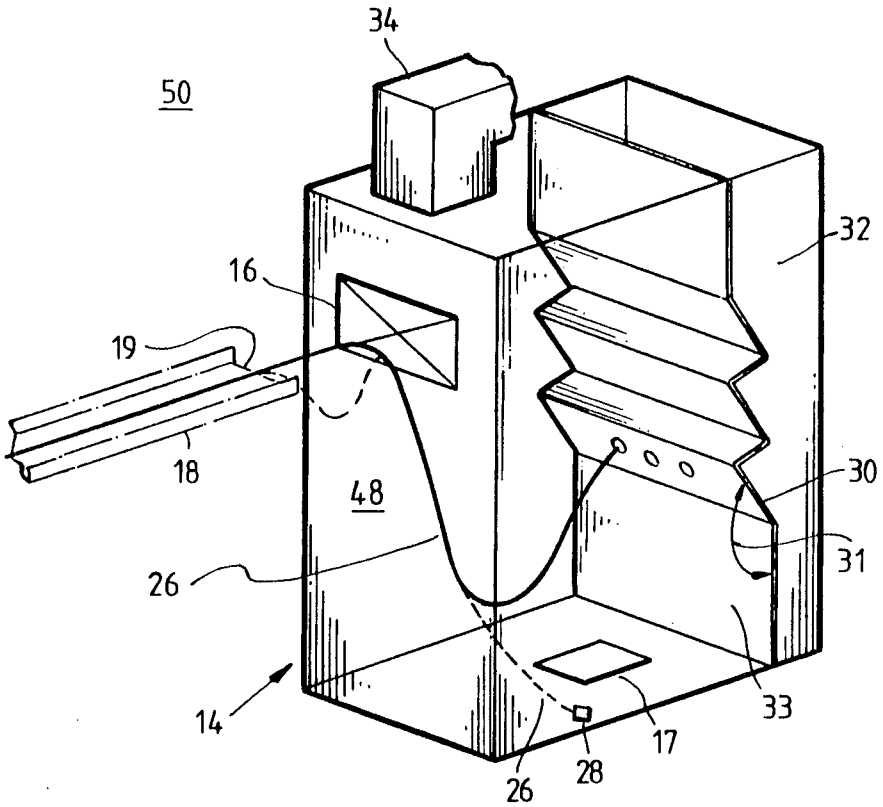
FIG. 2.

It may be desirable to warm an extended length of cable 26 by inserting the entire length of protruding cable or a substantial portion of it into the thermal chamber 14, as shown by the dotted lines extending cables 26 in FIG. 2, withdraw a portion of the warmed cable through the aperture 16, and allow the withdrawn portion of the cable to assume its natural catenary while in a warmed flexible condition suspended between the aperture 16 entry point and the end 19 of the cable harness boom 18 before refreezing. In some cases a portion of cable that extends beyond the end 19 of the boom 18 will remain frozen because it has not been inserted into the thermal cabinet 14. In such a case the end point of the frozen portion of the cable, instead of the boom, may serve as one end point for the catenary of the thawed portion of the cable.

The temperature in the thermal chamber is maintained by a heat source located in the module containing the thermal chamber. The module may have a boiler and a large diesel engine as heat sources. The thermal cabinet may have upper and lower openings to introduce warm air from the heat source into the thermal chamber. Air ducts may not always be necessary to maintain the temperature although air ducts may be used. Some cold air from outside may come in from time to time through the thermal chamber aperture where the cable has been inserted. However, the heat sources in the module have been sufficient to maintain the seventy degree ambient temperature within the thermal chamber. The space surrounding the cable in the thermal chamber aperture may be sealed to minimize heat leakage and cold air coming in through the aperture.

What is claimed is:

1. A method for electrically connecting a plurality of modules in a modular oil field system in a frigid environment comprising the steps of:

placing a cable boom on a first of a plurality of modules;

placing a set of electrical cables on a cable tray attached to the cable boom so that the cables protrude past the end of the cable boom;

rotating the free end of the cable boom containing the protruding cable ends away from the module from which the cables originate and toward an adjacent module;

providing a cabinet in the adjacent module with an aperture placed to receive the protruding cable ends;

introducing the protruding portion of the electrical cables through the apertures in the cabinet and into the cabinet in the adjacent module;

and connecting the cables to a cable connector panel located in the adjacent module.

2. The method of claim 1 further comprising the steps of:

heating said cabinet in the adjacent module to a temperature above the temperature outside the module;

and warming the cable prior to performing said connecting step sufficiently to render the cable flexible.

3. The method of claim 2 further comprising the steps of:

withdrawing a portion of the warmed cable from the cabinet while the cable is in a warm and flexible state.

4. The method of claim 2 further comprising the step of:

angling the connector panel sufficiently to increase the radius of curvature of cable bends that are required to connect the cable to the panel face.

5. The method of claim 4 further comprising the step of:

sealing said aperture to reduce leakage of heat and entry of cold air from the outside when said cables are introduced through the aperture and into the cabinet and also when no cables are introduced through aperture.

6. The method of claim 5 wherein said heating step comprises establishing a positive pressure in the cabinet by forcing heated air into the cabinet through air ducts.

7. An apparatus for electrically connecting modules in a modular oil field system under frigid conditions comprising:

a set of electrical cables which have opposite sets of cable ends;

a cable boom positioned on a first module and capable of supporting the set of cables such one set of cable ends protrude past the end of said cable boom;

a thermal cabinet located in an adjacent module and of a size to accommodate personnel;

and a border defining an aperture extending between the interior of said cabinet and the outside of said module for receiving said protruding set of cable ends.

8. The apparatus of claim 7 further comprising:

a heat generating means for heating said cabinet in the adjacent module to warm the inserted cables until they become flexible.

9. The apparatus of claim 8 further comprising:

cable connector panel within the cabinet with an angled panel face means to increase the radius of curvature of cable bending required to connect said protruding cable ends to said panel face.

10. The apparatus of claim 9 further comprising:

a sealing means adapted to seal the aperture to reduce leakage of heat from the cabinet and entry of cold air into the cabinet from the outside.

11. The apparatus of claim 10 further comprising:

an air duct arranged to discharge air into the cabinet, and wherein said heat generating means is of a character to heat and discharge air through said duct into said cabinet.

12. A frigid environment method for connecting frozen electrical cable, connected at one end to a first module of a modular drilling or workover system, to a second module in the system, comprising:

placing a rotatable cable boom on the first module enabling the boom to rotate toward the second module while carrying an electrical cable;

harnessing the electrical cable on the first module to be carried by the boom with the free end of the cable projecting beyond the boom toward the second module following rotation of the boom toward the second module;

providing the second module with a cable connector within a thermal cabinet which is sized to accommodate personnel and which is apertured to receive the projecting free end of the cable;

warming the free end of the cable, as necessary, within the cabinet to render the free end sufficiently flexible to be connected to said connector; and connecting the flexible free end to the connector.

13. Apparatus for use in a frigid environment to connect a frozen electrical cable, connected at one end to a first module of a modular drilling or workover system, to a second module in the system, comprising:

a rotatable cable boom adapted to support the cable and rotatably mounted on the first module to project the free end of the cable toward the second module;

a pressurized thermal cabinet within the second module sized to accommodate personnel and containing a cable connector panel; and an aperture in the second module positioned and adapted to receive the projecting free end of the cable for connection to the cable connector panel.

* * * * *